US008820754B2

(12) United States Patent
Stewart et al.

(10) Patent No.: US 8,820,754 B2
(45) Date of Patent: Sep. 2, 2014

(54) TURBINE BLADE SEAL ASSEMBLY

(75) Inventors: Jeffrey B. Stewart, Palm Beach Gardens, FL (US); Ronald J. Rudolph, Miami, FL (US); Gennadiy Afanasiev, Windermere, FL (US)

(73) Assignee: Siemens Energy, Inc., Orlando, FL (US)

( * ) Notice: Subject to any disclaimer, the term of this patent is extended or adjusted under 35 U.S.C. 154(b) by 155 days.

(21) Appl. No.: 13/151,363

(22) Filed: Jun. 2, 2011

(65) Prior Publication Data

US 2012/0049467 A1 Mar. 1, 2012

Related U.S. Application Data

(60) Provisional application No. 61/353,775, filed on Jun. 11, 2010.

(51) Int. Cl.

| | |
|---|---|
| ***F16J 15/02*** | (2006.01) |
| ***F01D 5/22*** | (2006.01) |
| ***F04D 29/08*** | (2006.01) |
| ***F01D 11/00*** | (2006.01) |

(52) U.S. Cl.

CPC ..... *F01D 5/22* (2013.01); *F04D 29/083* (2013.01); *F01D 11/006* (2013.01)

USPC ..... 277/641; 277/642; 277/643; 277/644

(58) Field of Classification Search

USPC ..... 277/630, 637, 641, 642, 643, 644

See application file for complete search history.

(56) References Cited

U.S. PATENT DOCUMENTS

| | | | | |
|---|---|---|---|---|
| 1,989,955 | A * | 2/1935 | Van Patter | 403/281 |
| 3,519,366 | A * | 7/1970 | Campbell | 415/138 |
| 3,709,631 | A | 1/1973 | Karstensen et al. | |
| 3,728,041 | A * | 4/1973 | Bertelson | 415/189 |
| 3,752,598 | A | 8/1973 | Bowers et al. | |
| 3,870,322 | A * | 3/1975 | Marshall | 277/643 |
| 3,975,114 | A * | 8/1976 | Kalkbrenner | 415/210.1 |
| 4,177,011 | A | 12/1979 | Eskesen et al. | |
| 4,507,052 | A | 3/1985 | Thompson | |
| 4,749,333 | A * | 6/1988 | Bonner et al. | 415/189 |
| 4,767,260 | A * | 8/1988 | Clevenger et al. | 415/115 |
| 4,872,812 | A | 10/1989 | Hendley et al. | |
| 4,936,749 | A | 6/1990 | Arrao et al. | |
| 5,156,528 | A | 10/1992 | Bobo | |
| 5,226,784 | A | 7/1993 | Mueller et al. | |
| 5,388,962 | A | 2/1995 | Wygle et al. | |
| 5,599,170 | A | 2/1997 | Marchi et al. | |
| 5,655,876 | A | 8/1997 | Rock et al. | |

(Continued)

FOREIGN PATENT DOCUMENTS

DE 102007037208 A1 2/2009

*Primary Examiner* — Kristina Fulton
*Assistant Examiner* — Eugene G Byrd

(57) ABSTRACT

A seal assembly for an axial flow gas turbine engine includes a rotatable component having a radially extending mate face, a seal slot formed in the mate face, and a seal member slidably disposed in the seal slot. The seal slot includes a radially outer wall and an opposing radially inner wall extending into the component in a circumferential direction from the mate face. The radially outer wall is angled radially inwardly from the mate face toward an inner end portion of the seal slot. Rotation of the seal assembly during operation of the engine produces a centrifugal force on the seal member to effect movement of the seal member in the circumferential direction out of the seal slot.

20 Claims, 6 Drawing Sheets

(56) References Cited

U.S. PATENT DOCUMENTS

| | | | | |
|---|---|---|---|---|
| 5,820,338 | A | 10/1998 | Kasprow et al. | |
| 6,086,329 | A * | 7/2000 | Tomita et al. | 416/193 A |
| 6,273,683 | B1 * | 8/2001 | Zagar et al. | 416/193 A |
| 6,561,764 | B1 | 5/2003 | Tiemann | |
| 6,857,639 | B2 * | 2/2005 | Beeck et al. | 277/637 |
| 7,121,802 | B2 | 10/2006 | Athans et al. | |
| 7,762,780 | B2 | 7/2010 | Decardenas | |
| 8,308,428 | B2 * | 11/2012 | Bridges et al. | 415/139 |
| 2004/0228731 | A1 | 11/2004 | Lagrange et al. | |
| 2008/0181779 | A1 | 7/2008 | Decardenas | |
| 2010/0111700 | A1 | 5/2010 | Kim et al. | |
| 2010/0129226 | A1 * | 5/2010 | Strohl et al. | 416/219 R |
| 2010/0178173 | A1 | 7/2010 | Charlton | |

* cited by examiner

TURBINE BLADE SEAL ASSEMBLY

CROSS-REFERENCE TO RELATED APPLICATION

This application claims the benefit of U.S. Provisional Application Ser. No. 61/353,775, entitled STRIP SEALS BETWEEN TURBINE BLADES, filed Jun. 11, 2010, the entire disclosure of which is incorporated by reference herein.

FIELD OF THE INVENTION

The present invention relates generally to a seal assembly for use in a turbine engine, and more particularly, to a seal assembly between adjacent rotating components, such as turbine blade assemblies, in the turbine engine.

BACKGROUND OF THE INVENTION

Cooling air and hot gas leakage between a hot gas path and cavities that contain cooling air in a gas turbine engine reduces engine performance and efficiency. For example, cooling air leakage from the cavities into the hot gas path can disrupt the flow of the hot gas and increase heat losses, thus reducing engine performance and efficiency. Further, cooling air leakage into the hot gas path requires higher primary combustion zone temperatures in the combustor to achieve desired engine firing temperatures. Moreover, hot gas leakage into the cavities leads to higher temperatures of components that are cooled with the cooling air from the cavities and may result in reduced performance, reduced service life and/or failure of these components.

In view of higher hot gas temperatures implemented in modern gas turbine engines, it is increasingly important to limit leakage between the hot gas path and the cavities to maximize engine performance and efficiency and to prevent damage to components that are cooled with the cooling air from the cavities.

SUMMARY OF THE INVENTION

In accordance with a first aspect of the present invention, a seal assembly is provided for limiting gas leakage between a hot gas path and a cavity containing cooling air in a turbine engine. The seal assembly comprises a first blade assembly, a second blade assembly, a first seal slot, and a first seal member. The first blade assembly comprises a first platform and a first airfoil, the first platform comprising a first mate face. The second blade assembly comprises a second platform and a second airfoil, the second platform comprising a second mate face located in opposing facing relationship with the first mate face. The first seal slot is formed in the first mate face and extends into the first platform in a circumferential direction of the engine. The first seal slot is defined by opposing radially inner and radially outer first walls of the first seal slot and by opposing second walls of the first seal slot extending between the first walls. At least the radially outer one of the first walls is angled relative to a line perpendicular to the first mate face such that an entry portion of the first seal slot located at the first mate face has a larger width than an inner end portion of the first seal slot. The first seal member is slidably disposed in the first seal slot and includes a circumferentially facing contact surface. Rotation of the seal assembly during operation of the engine causes an exertion of a centrifugal force on the first seal member in the radial direction so as to cause the first seal member to slide circumferentially partially out of the first seal slot to engage the contact surface into contact with the second mate face In accordance with a second aspect of the present invention, a seal assembly is provided for an axial flow gas turbine engine. The seal assembly comprises a rotatable component comprising a radially extending mate face, a seal slot formed in the mate face, and a seal member slidably disposed in the seal slot. The seal slot includes a radially outer wall and an opposing radially inner wall extending into the component in a circumferential direction from the mate face. The radially outer wall is angled radially inwardly from the mate face toward an inner end portion of the seal slot. Rotation of the seal assembly during operation of the engine produces a centrifugal force on the seal member to effect movement of the seal member in the circumferential direction out of the seal slot.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
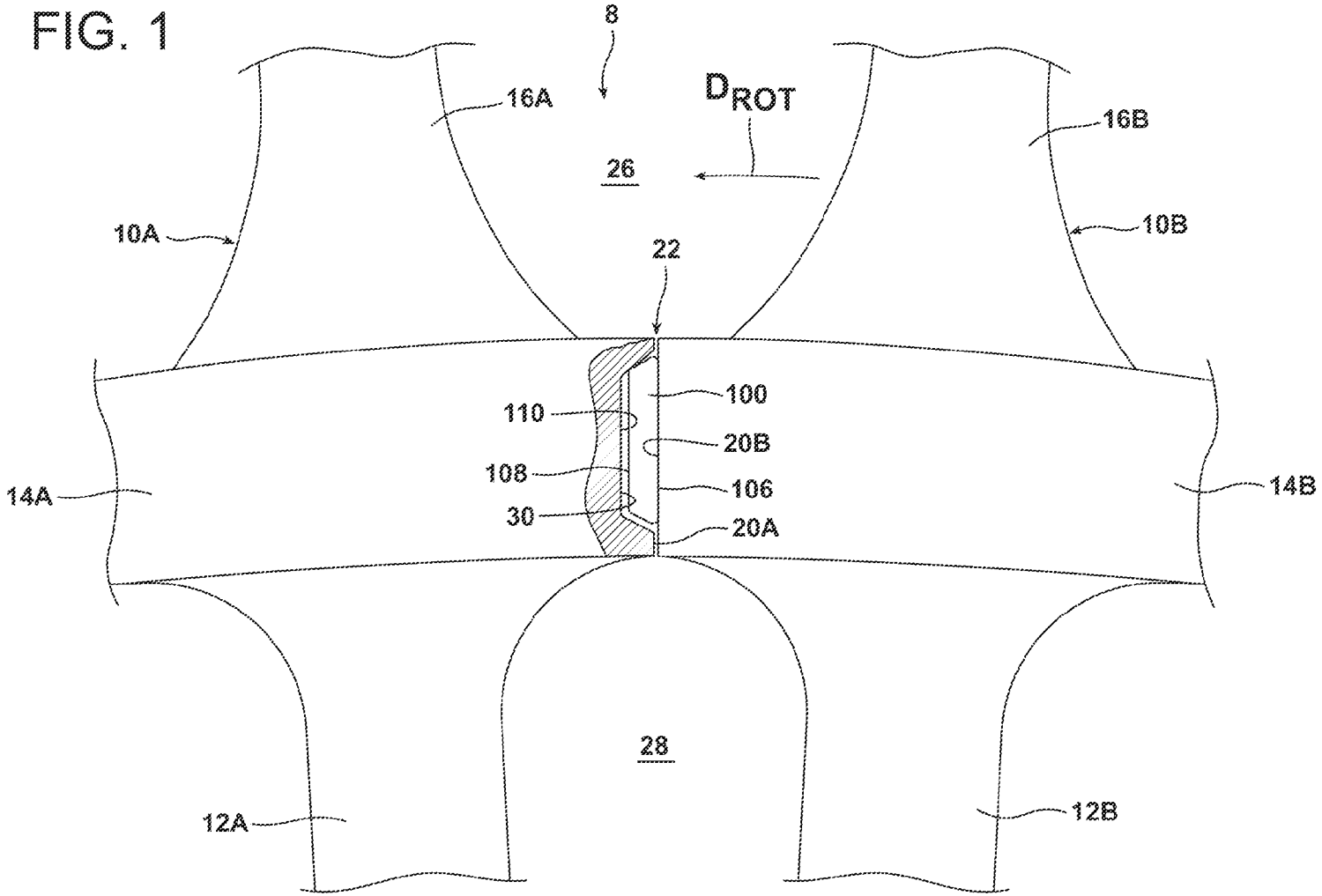
FIG. 1 is a fragmentary elevational view looking in an axial direction of a gas turbine engine and illustrating a seal assembly constructed in accordance with the present invention.

FIG. 1 illustrates a seal assembly 8 including adjacent rotatable first and second blade assemblies 10A, 10B in an axial flow gas turbine engine. Each blade assembly 10A, 10B includes a conventional root 12A, 12B for attaching the blade assembly 10A, 10B to a conventional rotor assembly (not shown), a platform 14A, 14B attached to the root 12A, 12B, and a conventional airfoil 16A, 16B attached to the platform 14A, 14B. As the roots 12A, 12B and airfoils 16A, 16B are conventional, these components will not be described in detail herein.

The platform 14A of the first blade assembly 10A (hereinafter "first platform 14A") comprises a radially extending first mate face 20A, see also FIGS. 2-6. The first mate face 20A is located in opposing facing relationship with a radially extending second mate face 20B of the platform 14B of the second blade assembly 10B (hereinafter "second platform 14B"). As shown in FIG. 1, the first and second mate faces 20A, 20B are in close proximity to each other but are spaced apart from one another such that a gap 22 is formed therebetween. Terms including the words "radial", "axial", "circumferential", "inner", "outer", and the like, as used herein, are not intended to be limiting with regard to orientation of the elements recited for the present invention.

The seal assembly 8 (to be more fully described below) is provided to seal the gap 22 during operation of the engine. Generally, as the first and second blade assemblies 10A, 10B rotate in a direction of rotation $D_{ROT}$ illustrated in FIG. 1, centrifugal forces exerted on components of the seal assembly 8 cause the seal assembly 8 to move into a sealing position, illustrated in FIG. 1. When in the sealing position, the seal assembly 8 substantially prevents gas leakage between a hot gas path 26 and a cavity 28. The hot gas path 26 contains hot combustion gases and is located radially outwardly from the first and second platforms 14A, 14B, which first and second platforms 14A, 14B form an inner boundary of the hot gas path 26. The cavity 28 contains cooling air, such as compressor discharge air, and is located radially inwardly from the first and second platforms 14A, 14B. Additional details in connection with the function of the seal assembly 8 will be discussed below.

Figure 2:
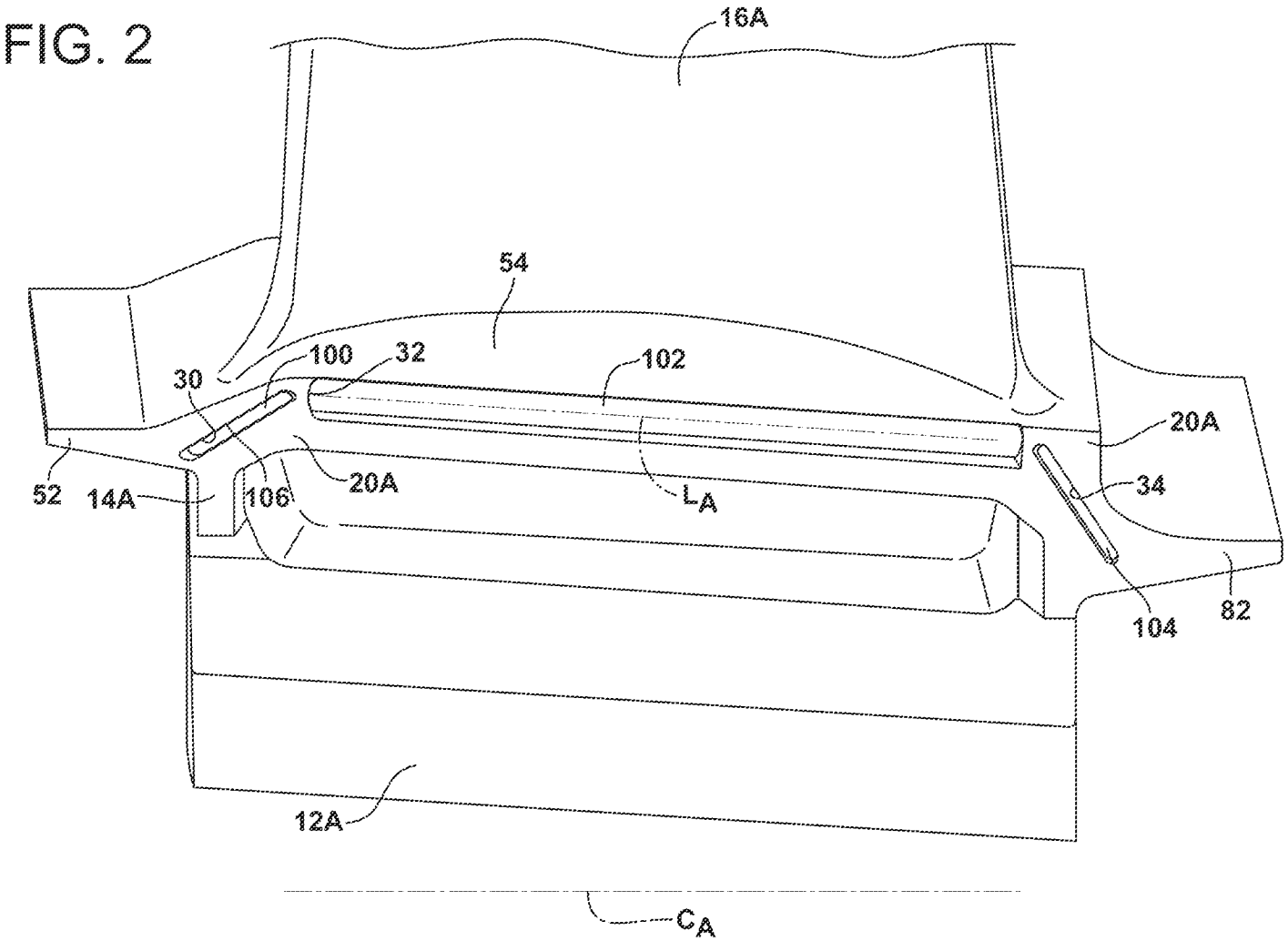
FIG. 2 is a fragmentary perspective view looking in a circumferential direction of the gas turbine engine and illustrating the seal assembly shown in FIG. 1.

Referring now to FIG. 2, the seal assembly further comprises a first seal slot 30, a damper slot 32, and a second seal slot 34. These slots 30, 32, 34 are formed in the first mate face 20A of the first platform 14A and extend from the first mate face 20A into the first platform 14A in a circumferential direction of the engine, i.e., in the direction of rotation $D_{ROT}$.

Figure 3:
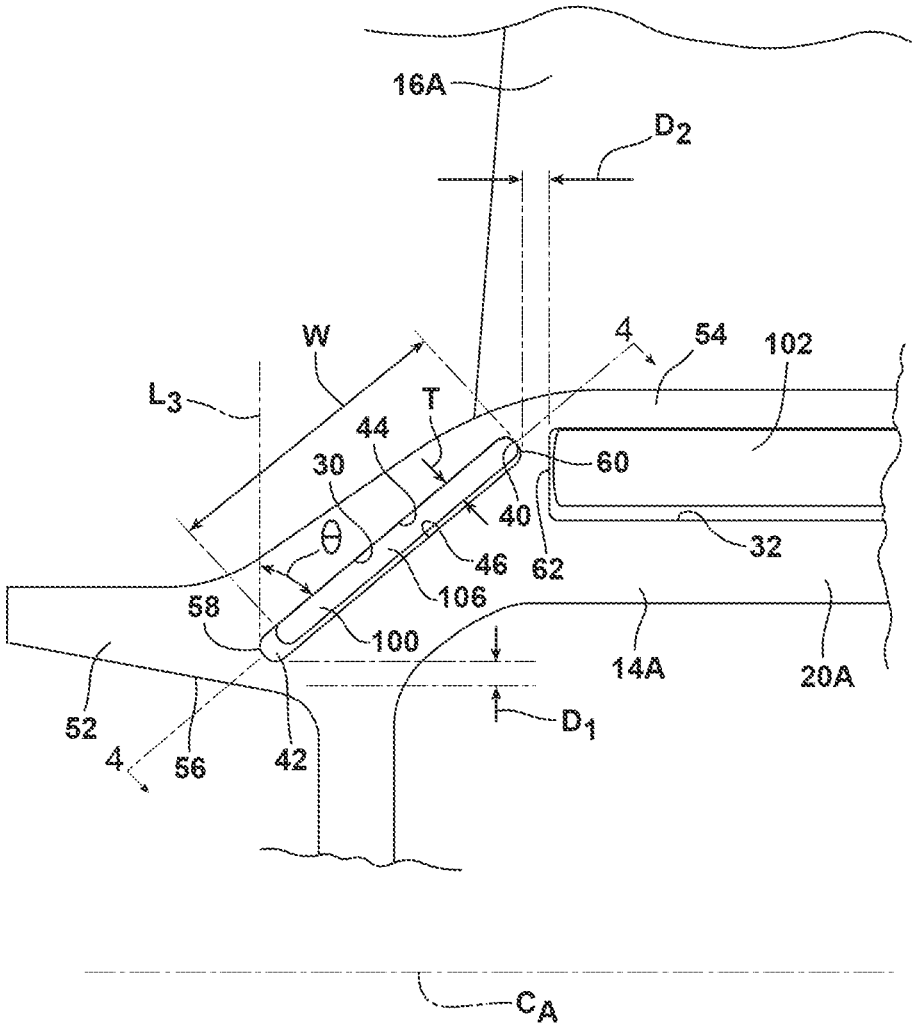
FIG. 3 is an enlarged side elevational view illustrating a first portion of the seal assembly illustrated in FIGS. 1 and 2.
Figure 4:
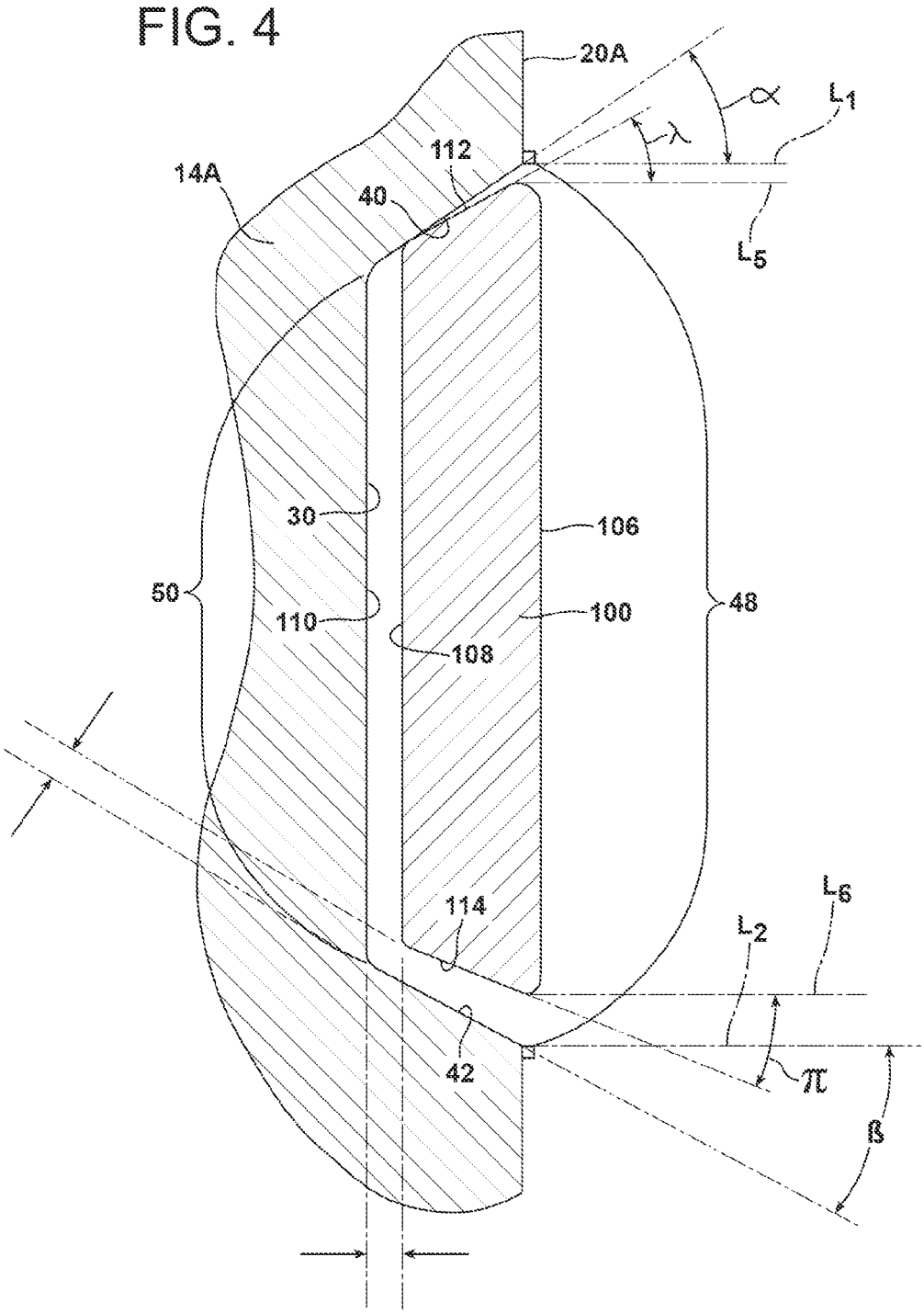
FIG. 4 is a cross sectional view taken along line 4-4 in FIG. 3.
Figure 5:
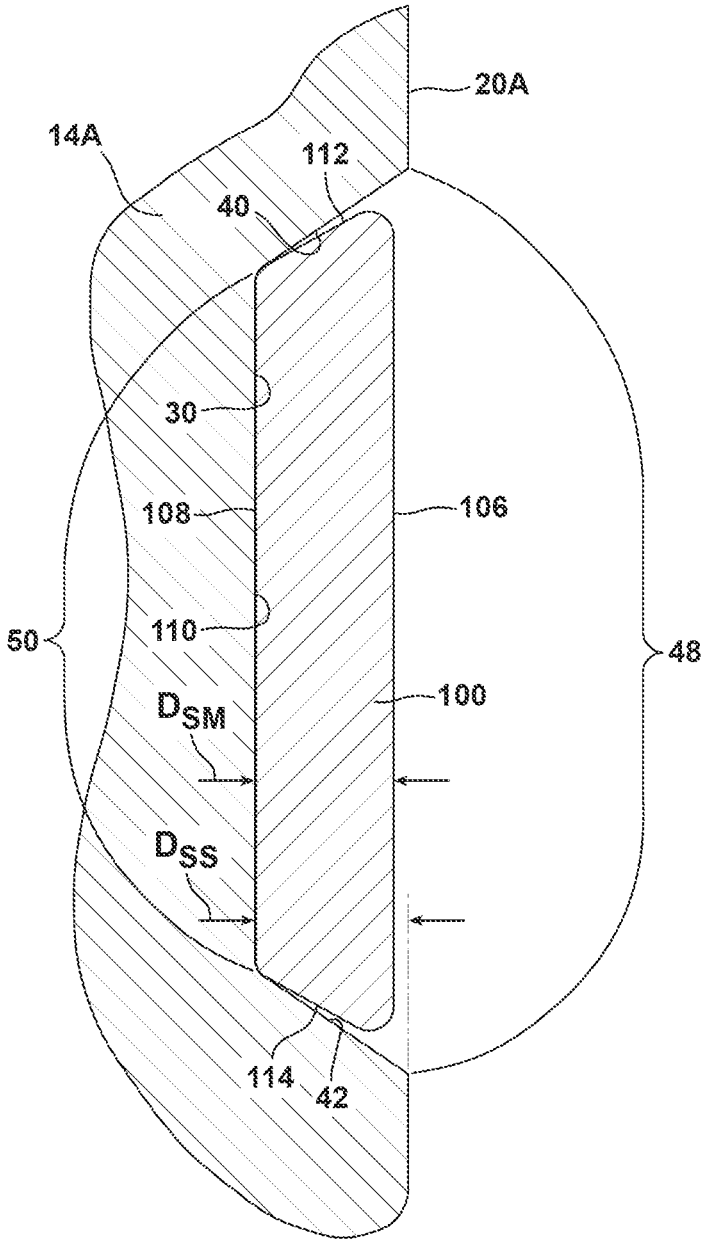
FIG. 5 is a cross sectional view similar to FIG. 4 but wherein a seal member of the seal assembly is located in a non-sealing position.

The first seal slot 30 is defined by opposing radially outer and inner first walls 40, 42, see FIGS. 3-5. The first seal slot 30 is further defined by opposing radially outer and inner second walls 44, 46 that extend between the first walls 40, 42 and are longer than the first walls 40, 42, i.e., the first walls 40, 42 are shorter than the second walls 44, 46, see FIG. 3. A depth $D_{SS}$ of the first seal slot 30 may be about 6.5 mm, see FIG. 5. It is noted that the distances and dimensions of the components of the seal assembly 8 presented herein are exemplary and may vary depending on the size and type of engine that the seal assembly 8 is applied in.

As shown in FIG. 4, in a preferred embodiment, both of the first walls 40, 42 (and at least the radially outer first wall 40), are angled relative to respective first and second lines $L_1$, $L_2$ that extend perpendicular to the first mate face 20A and that extend into the first mate face 20A, such that an entry portion 48 of the first seal slot 30 located at the first mate face 20A has a larger width than a circumferentially inner end portion 50 of the first seal slot 30. The first walls 40, 42 are angled toward each other in a direction from the first mate face 20A to the inner end portion 50 of the first seal slot 30, as shown in FIGS. 4 and 5. That is, the radially outer first wall 40 is angled radially inwardly from the first mate face 20A toward the inner end portion 50 of the first seal slot 30, i.e., the radially outer first wall 40 angles radially inwardly in a plane extending parallel to the first seal slot 30 at a first angle $\alpha$ measured from the line $L_1$, which angle $\alpha$ may be about 35° to about 45° , see FIG. 4. The radially inner first wall 42 is angled radially outwardly from the first mate face 20A toward the inner end portion 50 of the first seal slot 30, i.e., the radially inner first wall 42 angles radially outwardly in a plane extending parallel to the first seal slot 30 at a second angle $\beta$ measured from the line $L_2$, which angle $\beta$ may be about 30° to about 60° and is preferably from about 35° to about 45° , see FIG. 4. In a preferred embodiment, the angle $\alpha$ of the radially outer first wall 40 relative to the line $L_1$ is substantially equal to the angle $\beta$ of the radially inner first wall 42 relative to the line $L_2$.

Referring to FIG. 3, due to the first walls 40, 42 being shorter than the second walls 44, 46, the first seal slot 30 defines an elongated dimension extending across the first mate face 20A from the radially inner first wall 42 to the radially outer first wall 40. The elongated dimension angles axially from a forward outer axial side 52 of the first platform 14A toward a central portion 54 of the first platform 14A, extending radially outwardly. The first seal slot 30 may extend at an angle $\theta$ of about 30-55° relative to a line $L_3$ corresponding to a radius line extending radially outwardly relative to a central axis $C_A$ of the engine, see FIG. 3. In a preferred embodiment, a radial distance $D_1$ between a radially inner surface 56 of the first platform 14A at the forward outer axial side 52 and a radially innermost portion 58 of the first seal slot 30 is about 2 mm. Additionally, an axial distance $D_2$ between an axially aftmost portion 60 of the first seal slot 30 and an axially foremost portion 62 of the damper slot 32 is about 2 mm. As noted above, these dimensions may vary and they are preferably as small as possible without compromising the structural integrity of the first platform 14A.

In one embodiment, the first seal slot 30 may be formed in the first platform 14A at an angle relative to a plane perpendicular to the first mate face 14A, i.e., the inner end portion 50 of the first seal slot 30 may be positioned at different axial and radial locations than the entry portion 48 of the first seal slot 30.

Referring to FIG. 2, the damper slot 32 is elongated generally in an axial direction of the engine, which axial direction of the engine is generally parallel to the central axis $C_A$ of the engine. In a preferred embodiment, the damper slot 32 is radially positioned at a location that is substantially radially aligned with the radially outer first wall 40 of the first seal slot 30. Additionally, the damper slot 32 may comprise a sloped or ramped surface, such as the ramp in the pin-receiving groove disclosed in U.S. Pat. No. 7,762,780, the entire disclosure of which is hereby incorporated by reference in its entirety.

Figure 6:
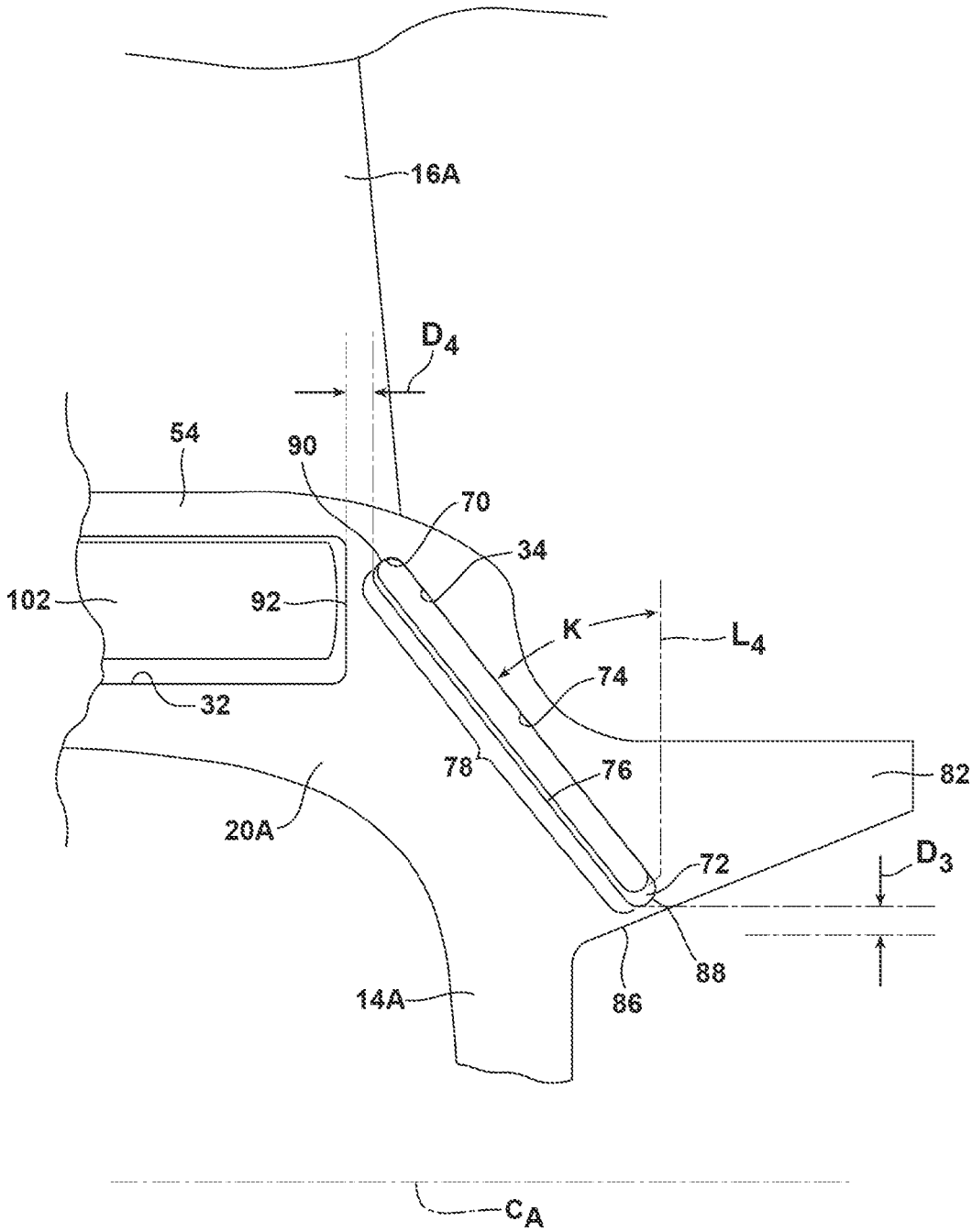
FIG. 6 is an enlarged side elevational view illustrating a second portion of the seal assembly illustrated in FIGS. 1 and 2.

Referring to FIG. 6, the second seal slot 34 is defined by opposing radially outer and inner first walls 70, 72. The second seal slot 34 is further defined by opposing radially outer and inner second walls 74, 76 that extend between the first walls 70, 72. Angles of the first walls 70, 72 of the second seal slot 34 are similar to the angles of the first walls 40, 42 of the first seal slot 30 described above, such that an entry portion 78 of the second seal slot 34 located at the first mate face 20A has a larger width than a circumferentially inner end portion (not shown) of the second seal slot 34. In a preferred embodiment, the radially outer first wall 70 of the second seal slot 34 is radially positioned at a location that is substantially radially aligned with the damper slot 32.

As shown in FIG. 6, the second seal slot 34 defines an elongated dimension extending across the first mate face 20A from the radially inner first wall 72 to the radially outer first wall 70. The elongated dimension angles axially from an aft outer axial side 82 of the first platform 14A toward the central portion 54 of the first platform 14A, extending radially outwardly. The second seal slot 34 may extend at an angle $\kappa$ of about 25-35° relative to a line $L_4$ corresponding to a radius line extending radially outwardly relative to the central axis $C_A$ of the engine. In a preferred embodiment, a radial distance $D_3$ between a radially inner surface 86 of the first platform 14A at the aft outer axial side 82 and a radially innermost portion 88 of the second seal slot 34 is about 2 mm. Additionally, an axial distance $D_4$ between a foremost portion 90 of the second seal slot 34 and an aftmost portion 92 of the damper slot 32 is about 2 mm.

Referring to FIG. 2, the seal assembly 8 further comprises a first seal member 100 slidably disposed in the first seal slot 30, a damper member 102 slidably disposed in the damper slot 32, and a second seal member 104 slidably disposed in the second seal slot 34.

The first seal member 100 comprises a circumferentially outwardly facing contact surface 106 (see FIGS. 1-5), and a circumferentially inwardly facing surface 108 (see FIGS. 1 and 4 and 5). The contact surface 106 engages the second mate face 20B of the second platform 14B when the seal assembly 8 is in a sealing position during operation of the engine, as shown in FIG. 1. When the seal assembly 8 is in a non-sealing position, i.e., when the engine is not operating and the blade assemblies 10A, 10B are not rotating or are rotating slowly (described below), at least a portion of the circumferentially inwardly facing surface 108 of the first seal member 100 may engage a rear wall 110 of the first seal slot 30, as shown in FIG. 5. A depth $D_{SM}$ of the first seal member 100 may be about 6.0 mm, see FIG. 5

The first seal member 100 preferably comprises a generally flat first strip seal having opposing radially outer and inner end surfaces 112, 114, see FIGS. 4 and 5. When the seal assembly 8 is in a non-sealing position and the first seal member 100 is located completely in the first seal slot 30, the outer and inner end surfaces 112, 114 may engage the respective first walls 40, 42 at locations within the first seal slot 30. In a preferred embodiment, the first seal member 100 comprises a thickness T of about 2.5 mm and a maximum width W of about 28-36 mm, see FIG. 3. In a preferred embodiment, the width W of the first seal member 100 is less than or equal to the width of the entry portion 48 of the first seal slot 30.

As shown in FIGS. 4 and 5, the radially outer end surface 112 of the seal member 100 is angled radially inwardly from the contact surface 106 to the circumferentially inwardly facing surface 108 and the radially inner end surface 114 of the seal member 100 is angled radially outwardly from the contact surface 106 to the circumferentially inwardly facing surface 108. The end surfaces 112, 114 of the first seal member 100 are angled from the contact surface 106 in generally the same direction as the respective first walls 40, 42 of the first seal slot 30 are angled relative to the first mate surface 20A of the first platform 14A. However, the end surfaces 112, 114 preferably have angles relative to respective lines $L_5$, $L_6$ that are slightly smaller than the angles α, β of the first walls 40, 42 relative to the respective lines $L_1$, $L_2$, wherein the lines $L_5$, $L_6$ are perpendicular to the contact surface 106 of the first seal member 100. For example, in one embodiment, the angle α of the first wall 40 relative to the line $L_1$ may be about 5° greater than an angle λ of the first end surface 112 relative to the line $L_5$, see FIG. 4. Similarly, the angle β of the second wall 42 relative to the line $L_2$ may be about 5° greater than an angle π of the second end surface 114 relative to the line $L_6$, see FIG. 4.

These differences between the angles α, β and the respective angles λ, π ensure that a centrifugal force exerted on the first seal member 100 effectively forces the contact surface 106 of the first seal member 100 into engagement with the second mate face 20B of the second platform 14B, as shown in FIG. 1. That is, the differences between the angles α, β and the respective angles λ, π effect that the contact points between first seal member 100 and the first seal slot 30 are to the left (as shown in FIG. 4) of a center of gravity of the first seal member 100. Such contact points effect a pivoting of the first seal member 100 out of the first seal slot 30, i.e., toward the second platform 14B, as a result of the centrifugal force exerted on the first seal member 100 during operation of the engine. If the contact points were shifted to the right (as shown in FIG. 4) of the center of gravity of the first seal member 100, the centrifugal force exerted on the first seal member 100 during operation of the engine may result in the first seal member 100 pivoting away from the second platform 14B.

In a preferred embodiment, the angle λ of the first end surface 112 of the first seal member 100 relative to the line $L_5$ is substantially equal to the angle π of the second end surface 114 of the first seal member 100 relative to the line $L_6$. Hence, the first seal member 100 defines a symmetrical member such that can be installed into the first seal slot 30 with either the first end surface 112 or the second end surface 114 engaging the radially outer first wall 40.

The damper member 102 may comprise a pin-shaped member as disclosed in U.S. Pat. No. 7,762,780. The damper member 102 is positioned in the damper slot 32 and comprises an elongated member having a longitudinal axis $L_A$ that extends generally parallel to the central axis of the engine, see FIG. 2. As noted above, the damper slot 32 is radially positioned at a location that is substantially aligned with the radially outer first wall 40 of the first seal slot 30 and with the radially outer first wall 70 of the second seal slot 34. Hence, the longitudinal axis $L_A$ of the damper member 102 and the respective radially outer first walls 40, 70 are located at radial locations substantially aligned with one another. It is noted that the damper member 102 may provide a damping function in addition to providing a sealing function, or the damper member 102 may only provide a sealing function, i.e., with no damping function.

The second seal member 104 is generally similar to the first seal member 100 and is configured with respect to the second seal slot 34 in generally the same manner as the first seal member 100 is configured with respect to the first seal slot 30, as described above. Hence, the specific details of the second seal member 104 and its configuration with respect to the second seal slot 34 will not be described separately herein.

During operation of the engine, rotation of the blade assemblies 10A, 10B in the direction of rotation $D_{ROT}$ causes the exertion of centrifugal forces on the components of the seal assembly 8. These centrifugal forces cause movement of the first seal member 100, the damper member 102, and the second seal member 104.

Movement of the first seal member 100 in the first seal slot 30 caused by the centrifugal force exerted on the first seal member 100 will now be described, it being understood that this description also applies to movement of the second seal member 104 in the second seal slot 34.

The centrifugal force includes a radial force component, which overcomes the frictional force corresponding to the engagement of the radially outer end surface 112 of the first seal member 100 with the radially outer first wall 40 of the first seal slot 30, i.e., at a limited area of contact between the end of the outer end surface 112 adjacent to the circumferentially inwardly facing surface 108, and overcomes the frictional forces corresponding to the engagement of the first seal member 100 with the second walls 44, 46 so as to urge the first seal member 100 radially outwardly. Since the radially outer end surface 112 is in contact with the radially outer first wall 40, the radial force component of the centrifugal force exerted on the first seal member 100 generates a circumferential load, which causes the first seal member 100 to slide circumferentially out of the first seal slot 30, i.e., the radially outer end surface 112 of the first seal member 100 slides on the radially outer first wall 40 of the first seal slot 30 so as to push the first seal member 100 out of the first seal slot 30.

The first seal member 100 slides circumferentially partially out of the first seal slot 30 until the contact surface 106 of the first seal member 100 contacts the second mate face 20B of the second platform 14B, as shown in FIG. 1. At this point, the first seal member 100 is still partially located within the first seal slot 30 and is in sealing engagement with the second mate face 20B of the second platform 14B so as to seal the portion of the gap 22 associated with the first seal member 100. Similarly, the second seal member 104 slides circumferentially partially out of the second seal slot 34 into sealing engagement with the second mate face 20B of the second platform 14B so as to seal the portion of the gap 22 associated with the second seal member 104.

The centrifugal force exerted on the damper member 102 causes the damper member 102 to move partially out of the damper slot 32 and into sealing engagement with the second mate face 20B of the second platform 14B so as to seal the portion of the gap 22 associated with the damper member 102. For additional information on movement of the damper member 102, see U.S. Pat. No. 7,762,780.

With the first and second seal members 100, 104 and the damper member 102 in their respective sealing positions, the seal assembly 8 substantially prevents or limits gas leakage between the hot gas path 26 and the cavity 28. Since the first and second seal members 100, 104 are located in close proximity to the ends of the damper member 102, gaps between the seal members 100, 104 and the damper member 102 are small such that there is relatively little gas leakage therebetween.

After the completion of a normal engine operation cycle, rotation of the blade assemblies 10A, 10B is terminated or is slowed down to between about 3-120 RPM in what is referred to as "turning gear" operation. During turning gear operation, the centrifugal forces exerted on the components of the seal assembly 8 are greatly reduced, such that gravitational forces on the first and second seal members 100, 104 and the damper member 102 are able to overcome the centrifugal force exerted on these components. Upon the gravitational forces overcoming the centrifugal force exerted on the first and second seal members 100, 104 and the damper member 102, these components may be caused to move out of their associated sealing positions.

Since the end surfaces 112, 114 of the first seal member 100 (this description also pertains to the second seal member 104) have angles relative to the respective lines $L_1$, $L_2$ that are less than the angles $\alpha$, $\beta$ of the first walls 40, 42 of the first seal slot 30 relative to the respective lines $L_1$, $L_2$, the seal member 100 is able to move unhindered back into a non-sealing position within the seal slot 30. That is, the end surfaces 112, 114 of the seal member 100 cannot be caught on the first walls 40, 42 of the seal slot 30 when the seal member 100 is retracting back into a non-sealing position within the seal slot 30.

In addition, since the first seal member 100 is capable of being retracted completely into the first seal slot 30 in the first blade assembly 10A and is not positioned within a second seal slot formed in the second blade assembly 10B, the first seal member 100 does not interfere with removal and re-assembly of the blade first assembly 10A. That is, prior art seal members that are arranged in respective seal slots in adjacent platforms do not allow for blade assemblies to be removed individually. This is due to the fact that portions of such prior art seal members are positioned in seal slots of both of the adjacent blade assemblies, such that the blade assemblies would have to be removed together, since each blade assembly includes a portion of the seal member positioned therein. Further, since each prior art blade assembly would include seal members on both sides, all of the blade assemblies in prior art engines that employ such seal members would have to be removed at once, thus increasing the complexity and difficulty associated with removing and re-assembling the blade assemblies.

While a particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A seal assembly for limiting gas leakage between a hot gas path and a cavity containing cooling air in a turbine engine, the seal assembly comprising:

a first blade assembly comprising a first platform and a first airfoil, said first platform comprising a first mate face;

a second blade assembly comprising a second platform and a second airfoil, said second platform comprising a second mate face located in opposing facing relationship with said first mate face;

a first seal slot formed in said first mate face and extending into said first platform in a circumferential direction of the engine, wherein said first seal slot is defined by opposing radially inner and radially outer first walls of said first seal slot and by opposing second walls of said first seal slot extending between said first walls, wherein:

said first walls are shorter than said second walls such that said first seal slot defines an elongated dimension extending across said first mate face from said radially inner first wall to said radially outer first wall; and at least the radially outer one of said first walls is angled relative to a line that:

is perpendicular to said first mate face; and extends into said first mate face such that an entry portion of said first seal slot located at said first mate face has a larger width than an inner end portion of said first seal slot;

a first seal member slidably disposed in said first seal slot and including a circumferentially facing contact surface; and wherein rotation of the seal assembly during operation of the engine causes an exertion of a centrifugal force on said first seal member in the radial direction so as to cause said first seal member to slide circumferentially partially out of said first seal slot to engage said contact surface into contact with said second mate face.

2. The seal assembly of claim 1, wherein said first seal member comprises a generally flat first strip seal having opposing radially inner and radially outer end surfaces that engage said first walls when said first strip seal is located in said first seal slot, said radially outer end surface being angled from said contact surface of said first strip seal in generally the same direction as said radially outer first wall but having an angle relative to a line perpendicular to said contact surface that is smaller than an angle of said radially outer first wall relative to a line perpendicular to said first mate face.

3. The seal assembly of claim 1, wherein said first walls angle toward each other in a direction from said first mate face to said inner end portion of said first seal slot.

4. The seal assembly of claim 3, wherein said first seal member comprises a generally flat first strip seal having opposing end surfaces that engage said first walls when said first strip seal is located in said first seal slot, said end surfaces being angled from said contact surface of said first strip seal in generally the same direction as said respective first walls but having angles relative to respective lines perpendicular to said contact surface that are different than angles of said first walls relative to respective lines perpendicular to said first mate face.

5. The seal assembly of claim 4, wherein said first walls are angled within a range of about 30° to about 60° relative to respective lines perpendicular to said first mate face.

6. The seal assembly of claim 5, wherein said first walls are angled relative to the respective lines perpendicular to said first mate face about 5° more than said end surfaces are angled relative to the respective lines perpendicular to said contact surface.

7. The seal assembly of claim 4, wherein said first strip seal comprises a thickness of about 2.5 mm.

8. The seal assembly of claim 1, further including a damper member positioned in a damper slot extending into said platform in the circumferential direction, said damper member comprising an elongated member having a longitudinal axis extending generally parallel to an axis of the engine, and said radially outer first wall of said first seal slot being located at a radial location substantially aligned with said longitudinal axis of said damper member.

9. The seal assembly of claim 1, wherein said elongated dimension angles axially from an outer axial side of said first platform toward a central portion of said first platform, extending outwardly in the radial direction.

10. The seal assembly of claim 1, further comprising:

a second seal slot formed in said first mate face and extending into said first platform in the circumferential direction of the engine, wherein said second seal slot is defined by opposing radially inner and radially outer first walls of said second seal slot and by opposing second walls of said second seal slot extending between said first walls, wherein:

said first walls are shorter than said second walls such that said second seal slot defines an elongated dimension extending across said first mate face from said radially inner first wall to said radially outer first wall of said second seal slot and at least one of said first walls of said second seal slot is angled relative to a line perpendicular to said first mate face and extending into said first mate face such that an entry portion of said second seal slot located at said first mate face has a larger width than an inner end portion of said second seal slot;

a second seal member slidably disposed in said second seal slot and including a circumferentially facing contact surface; and wherein rotation of the seal assembly during operation of the engine causes an exertion of a centrifugal force on said second seal member in the radial direction so as to cause said second seal member to slide circumferentially partially out of said second seal slot to engage said contact surface into contact with said second mate face.

11. A seal assembly for an axial flow gas turbine engine, the seal assembly comprising:

a rotatable component comprising a radially extending mate face;

a seal slot formed in said mate face, said seal slot including:

opposed first walls comprising a radially outer wall and an opposing radially inner wall extending into said component in a circumferential direction from said mate face; and opposed second walls extending between said first walls, wherein said first walls are shorter than said second walls such that said seal slot defines an elongated dimension extending across said mate face from said radially inner wall to said radially outer wall, and said radially outer wall being angled radially inwardly from said mate face toward an inner end portion of said seal slot;

a seal member slidably disposed in said seal slot; and wherein rotation of the seal assembly during operation of the engine produces a centrifugal force on said seal member to effect movement of said seal member in the circumferential direction out of said seal slot.

12. The seal assembly of claim 11, wherein said seal member comprises a generally flat strip seal and includes a radially outer end surface located for engagement with said radially outer wall.

13. The seal assembly of claim 12, wherein said radially outer end surface of said seal member is angled radially inwardly from a circumferentially outwardly facing contact surface to a circumferentially inwardly facing surface.

14. The seal assembly of claim 13, wherein:

said radially outer wall angles radially inwardly in a plane extending parallel to said seal slot at a first angle measured from a line perpendicular to said mate face and extending into said mate face;

said radially outer end surface angles radially inwardly at a second angle measured from a line perpendicular to said contact surface; and said first angle is greater than said second angle to effect a greater engagement force of said radially outer end surface against said radially outer wall at a location along said radially outer end surface adjacent to said inwardly facing surface of said seal member.

15. The seal assembly of claim 14, wherein said first angle is about 5° greater than said second angle.

16. The seal assembly of claim 15, wherein said first angle is within a range from about 35° to about 45°.

17. The seal assembly of claim 13, wherein said radially inner end surface of said seal member is angled radially outwardly from said contact surface to said inwardly facing surface.

18. The seal assembly of claim 17, wherein an angle of said radially inner end surface relative a line perpendicular to said contact surface is substantially equal to an angle of said radially outer end surface relative a line perpendicular to said contact surface.

19. The seal assembly of claim 11, wherein said elongated dimension angles axially from an outer axial side of said component toward a central portion of said component, extending outwardly in the radial direction.

20. The seal assembly of claim 19, further including a damper member positioned in a damper slot extending into said component in the circumferential direction, said damper member comprising an elongated member having a longitudinal axis extending generally parallel to an axis of the engine, and said radially outer wall of said seal slot being located at a radial location substantially aligned with said longitudinal axis of said damper member.

* * * * *